US007297044B2

(12) United States Patent
Small et al.

(10) Patent No.: US 7,297,044 B2
(45) Date of Patent: Nov. 20, 2007

(54) METHOD, APPARATUS, AND SYSTEM TO SYNCHRONIZE PROCESSORS IN TOYS

(75) Inventors: David Small, San Jose, CA (US); Brian Farley, Dublin, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 784 days.

(21) Appl. No.: 10/228,447

(22) Filed: Aug. 26, 2002

(65) Prior Publication Data

US 2004/0038620 A1 Feb. 26, 2004

(51) Int. Cl.
*A63H 33/00* (2006.01)

(52) U.S. Cl. ..... 446/454; 446/175

(58) Field of Classification Search ..... 446/436, 446/454, 175; 700/245–249
See application file for complete search history.

(56) References Cited

U.S. PATENT DOCUMENTS

| | | | | |
|---|---|---|---|---|
| 3,846,603 | A * | 11/1974 | Houser | 200/458 |
| 4,169,335 | A * | 10/1979 | Betancourt | 446/297 |
| 4,913,676 | A * | 4/1990 | Koguchi et al. | 446/300 |
| 5,446,236 | A * | 8/1995 | Nakada et al. | 84/102 |
| 5,452,901 | A * | 9/1995 | Nakada et al. | 446/454 |
| 5,587,545 | A | 12/1996 | Nakada et al. | |
| 5,873,765 | A | 2/1999 | Rifkin et al. | |
| 6,037,679 | A * | 3/2000 | Pirillo | 307/125 |
| 6,075,195 | A | 6/2000 | Gabai et al. | |
| 6,110,000 | A | 8/2000 | Ting | |
| 6,246,927 | B1 * | 6/2001 | Dratman | 700/246 |
| 6,264,523 | B1 * | 7/2001 | Simmons | 446/143 |
| 6,491,566 | B2 | 12/2002 | Peters et al. | |
| 6,682,392 | B2 * | 1/2004 | Chan | 446/335 |
| 6,822,154 | B1 * | 11/2004 | Thai | 84/609 |
| 2002/0077021 | A1 | 6/2002 | Cho et al. | |
| 2002/0155783 | A1 | 10/2002 | Chan | |
| 2002/0187722 | A1 | 12/2002 | Fong et al. | |

FOREIGN PATENT DOCUMENTS

| | | | |
|---|---|---|---|
| JP | 07163765 | A | 6/1995 |
| JP | 07246284 | A | 9/1995 |

* cited by examiner

*Primary Examiner*—Robert E. Pezzuto
*Assistant Examiner*—Alex P. Rada, II
(74) *Attorney, Agent, or Firm*—Blakely, Sokoloff, Taylor & Zafman LLP

(57) ABSTRACT

The invention generally relates to a method, apparatus, and system to synchronize timers or clocks of toys. A play-set includes a first toy having a first timer and a start button. The first toy can be designated as a master when the start button is depressed. After being designated as the master, the first toy sends a synchronization signal to begin synchronization. The play-set also includes a second toy communicatively linked to the first toy. The second toy has a second timer, and synchronizes the second timer to the first timer of the first toy in response to the synchronization signal. After timer synchronization, scripts are selected and a script start signal synchronizes the beginning of script play.

26 Claims, 9 Drawing Sheets

METHOD, APPARATUS, AND SYSTEM TO SYNCHRONIZE PROCESSORS IN TOYS

FIELD OF INVENTION

The invention generally relates to a method, apparatus, and system to synchronize programs, timers or clocks of microprocessors or audio processors used in toys.

BACKGROUND OF INVENTION

Over the last few decades, designers in the toy field have developed many types of toys using low cost microprocessors and audio processors. An audible toy can be defined as a device that outputs audio or audible sounds. The audio or audible sounds can be used to narrate a portion of a dialog. These low cost processors are typically operated with resistor oscillators to generate an internal processor clock. The oscillation frequency of these resistor oscillators can vary dramatically from unit to unit due to a number of factors. Many of these processor resistor oscillators have an oscillation specification tolerance of +/−10% for any given resistor value, a voltage deviation tolerance of up to 12.5% per volt and a temperature deviation tolerance of up to 7% over the operating range. When designing toy applications using these low cost processors, frequency deviations in the processor clock may need to be taken into account.

DETAILED DESCRIPTION

Figure 1A:
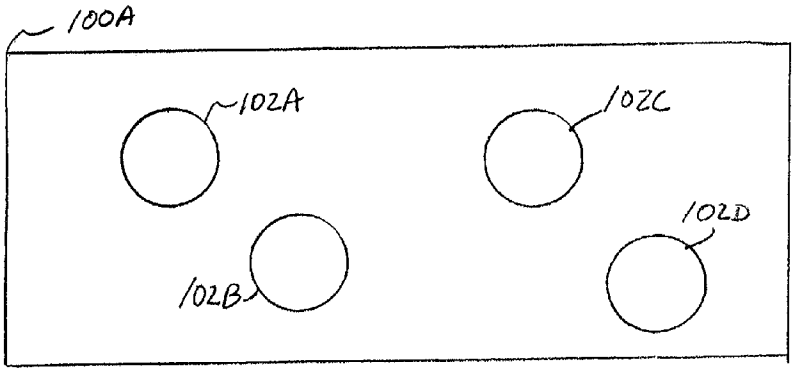
FIG. 1A illustrates an exemplary play-set or neighborhood with a plurality of toys or toy characters in accordance with one embodiment of the invention.

The invention relates to a method, apparatus, and system to synchronize programs, timers or clocks of toys. The synchronization process allows processors, such as microprocessors or sound processors in separate toys or toy characters to synchronize the programs and/or timing structure in each with respect to one another. The program and timing synchronization may be facilitated by a momentary dual contact between the toys, thereafter the toys can be disconnected and remain in synchronization for a period of time. The program and timing synchronization can also be facilitated wirelessly by a very short burst of communication between the toys, thereafter the toys need not communicate and will remain in time synchronization for a period of time. Multiple toys can be synchronized together by selecting one as a master with other toys in a neighborhood remaining as slaves. The master toy generates a synchronization timing pulse that is broadcast in the neighborhood to all the slave toys and stored as a base reference for timing. Each slave toy measures the timing pulse in order to synchronize their processors timers with the master toy's processor timers.

Each processor has a timer which is a programmable division of the CPU clock. The timer in each processor may be a hardware timer or counter or alternatively a software timer or counter. In either case, the timer or counter is used for synchronization. In a system, the slave toys will synchronize their timers to match that of the master toy so that scripts can be played by each in a synchronized manner. With their timers or counters running at the same speed and advancing at the same time, scripted events can be triggered at appropriate moments in time.

Each count of the timer or counter may be several hundred to several million processor clock cycles depending upon the frequency of processor that is used. The processor clock in each toy of a neighborhood may be operating at a different frequency due to a number of factors. These factors may include that each processor is designed to operate at a different frequency or that the processors are running at different frequencies due to frequency tolerance variations attributed to processor component tolerances, external oscillator component tolerances, voltage variances or temperature variances. In order to have the timer or counter in each toy advance at the same time, the toys in the neighborhood must determine the number of counts of the processor clock that each toy measures for a particular period of time. To facilitate this time period synchronization, the master unit transmits a synchronization signal to all the slaves in the neighborhood. This synchronization signal declares to all units in the neighborhood a period of time as perceived by the master. This time period for instance may be 512 counts of the master units' counter which for purposes of example may represent 64 ms as perceived by the master processor. Each slave unit measures this time period using its own counter that may be running at a different rate due to differences in its processor clock frequency. The slave units then divide this measured time period by 512 counts as this is the number of counts used by the master unit to generate the signal. In doing so each slave unit can determine the number of its own CPU clock cycles that represent 1 count of the master units timer. By way of example, slave unit 1 may measure this time period as 457 counts and slave unit 2 may measure this time period as 590 counts. The slave units store this number of CPU clock cycles per timer count in order to allow all units in the neighborhood to match the timer counting rate of the master unit. The matched timers can now be used by each unit to control a script or program event timer so that each unit will be able to advance the script or program at this agreed upon rate and thereby maintain synchronization with respect to one another.

Whether or not the toys processors are synchronized, the master unit must generate a program start pulse. If a script length is very short such as 5 seconds to 10 seconds in length, very accurate processor timing synchronization is not as critical as starting the scripts simultaneously. If on the other hand the script length is long such as 30 seconds to many minutes, timer synchronization becomes very critical. In either event, it is desirable that all scripts start at substantially the same time.

The synchronization provided by the invention allows separate toys to perform various tasks in synchronization such as simulating an intelligent voice dialogue without having the toys in actual continuous communication with one another. Pre-programmed scripts can be used to generate a voice dialogue, motion functions, light sequences or any other I/O script to form a play sequence of one or more toys. In one embodiment, each toy may be assigned a designated role with a designated script. There may be lead roles and supporting roles performed by the synchronized toys. In another embodiment, each toy has all the scripts for each role. The toy selected as the master toy plays the lead role and the other toys remain as slave toys and play supporting roles. In another embodiment, there are multiple toys in a neighborhood with identical lead roles for which only one will play the lead role at a time. The remaining toys with the identical lead roles return to a lower power sleep mode in one embodiment or alternatively play a supporting role in another embodiment. In all cases scripts are programmed to take into account only the toys that are present during the synchronization process. A line of toys may contain eight unique characters or toy variations. The scripts can be written to accommodate all eight unique characters or toy variations. In practice, there may be anywhere from two to eight toys present in a neighborhood for synchronization. In the synchronization process the toys in a neighborhood include a unique character or toy identification. The identity of the toys or toy characters present and the identity of the scripts to be performed can be communicated during synchronization. The pre-programmed scripts may be embedded within the software code of the processors or alternatively stored external to the processor. In another embodiment, the script can be hard coded in hardware.

FIG. 1A illustrates an exemplary play-set or neighborhood 100A with a plurality of toys or toy characters 102 in accordance with one embodiment of the invention. The plurality of toys or toy characters 102 may also be considered as a toy system or a system of toys. The play-set or neighborhood 100A may be a room within a house or an area in which the plurality of toy characters may communicate. The neighborhood 100A includes a first toy character 102A, second toy character 102B, a third toy character 102C, and a fourth toy character 102D. It should be noted that more or less than four toy characters 102 can be included in the neighborhood 100A with at least two toy characters 102 being in the neighborhood for the purpose of synchronization. In one embodiment, the toys or toy characters in the neighborhood are audible toys or audible toy characters with audible sound generation. In another embodiment, the toys or toy characters in the neighborhood are mechanical toys or mechanical toy characters with mechanical movement. In another embodiment, the toys or toy characters in the neighborhood are toys or toy characters with both mechanical movement and audible sound generation.

The toy characters 102A-102D have the capability of communicating wirelessly among themselves. For the purpose of synchronization, each of the toy characters 102A-102D initially acts as a slave toy or slave toy character initially listening for a synchronization signal. Each of the toy characters 102A-102D includes a button or switch or some other means for an end user to select one as a master toy. For example, a user may choose toy character 102B to be the master by pressing a button or switch or other means thereon. In which case, the remaining toy characters in the neighborhood 100A remain slaves. With toy character 102B being the master, toy characters 102A, 102C, and 102D are slaves to the toy character 102B for the purposes of synchronization. The button or switch may be a push-button to close a switch in a circuit or a slideable knob that slides to close a switch for example.

Furthermore, each of the toys or toy characters 102A-102D in the neighborhood 100A has a script of sounds and/or voices that each toy character may uniquely generate through a speaker. For example, assume that the play-set or neighborhood 100A is a firehouse with the toy characters 102A-102D being firemen. In which case, a user may select or designate one of the firemen 102A-102D to be the Fire Chief and the master for synchronization purposes. To designate one of the firemen to be the Fire Chief and the master, the user may push a button or switch on the selected fireman to select it as the Fire Chief and the master.

The master toy character sends out a synchronization signal to the slave toy characters that are listening for the synchronization signal. The slave toys or toy characters then synchronize their timers or clocks to this synchronization signal, so that each toy character may audibly and synchronously perform its respective role in the neighborhood 100A in accordance with a designated script. Once the toy characters 102A-102D have synchronized their respective timers or clocks, they may independently run and generate audible sounds or programmed events in accordance with a designated script. For example, if toy character 102B is the Fire Chief and the master, it may audibly report through its speaker into the neighborhood 100A that there is a fire somewhere, and may ask the other firemen to get ready to go to the fire. The other firemen, functioning as slaves or slave toy characters 102A, 102C-102D, may then report to the master 102B that they are ready to go to the fire and thus simulate that they are interacting with one another.

Figure 1B:
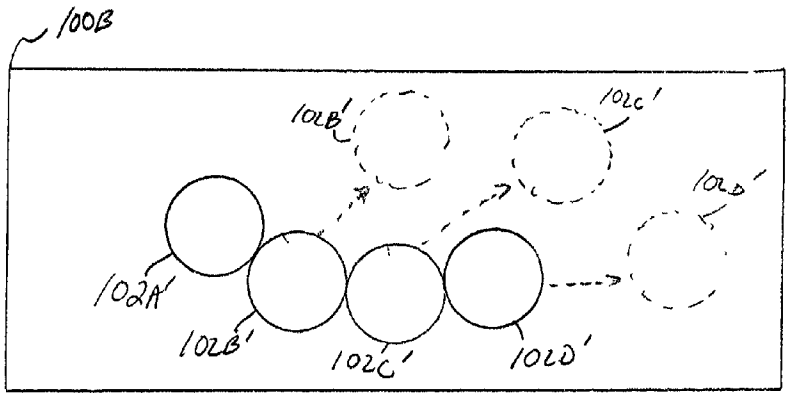
FIG. 1B illustrates an alternative play-set or neighborhood in accordance with one embodiment of the invention.

Referring now to FIG. 1B, an alternative embodiment of the invention is described. FIG. 1B illustrates an alternative play-set or neighborhood 100B in accordance with one embodiment of the invention. The neighborhood 100B may be a construction site, a firehouse, a racing pit, a police station or a bakery or some other ordinarily experienced setting in which individuals may audibly communicate. In this embodiment, the toy characters 102A', 102B', 102C' and 102D', initially touch each other for the purpose of synchronization. With the toy characters 102A', 102B', 102C' and 102D' physically touching, the user may select one toy character to be a master and the remaining toy characters to be slaves. After the selection of the master, the toy characters 102' synchronize to the frequency and timing of the clock of the processor of the master. Once the toy characters 102' are synchronized, they may be moved away from each other to positions within the neighborhood and may simulate their interactivity by audibly communicating outward into the neighborhood 100B. FIG. 1B illustrates toy characters 102B', 102C' and 102D' being moved in the neighborhood after synchronization with the master toy character 102A'.

Figure 2A:
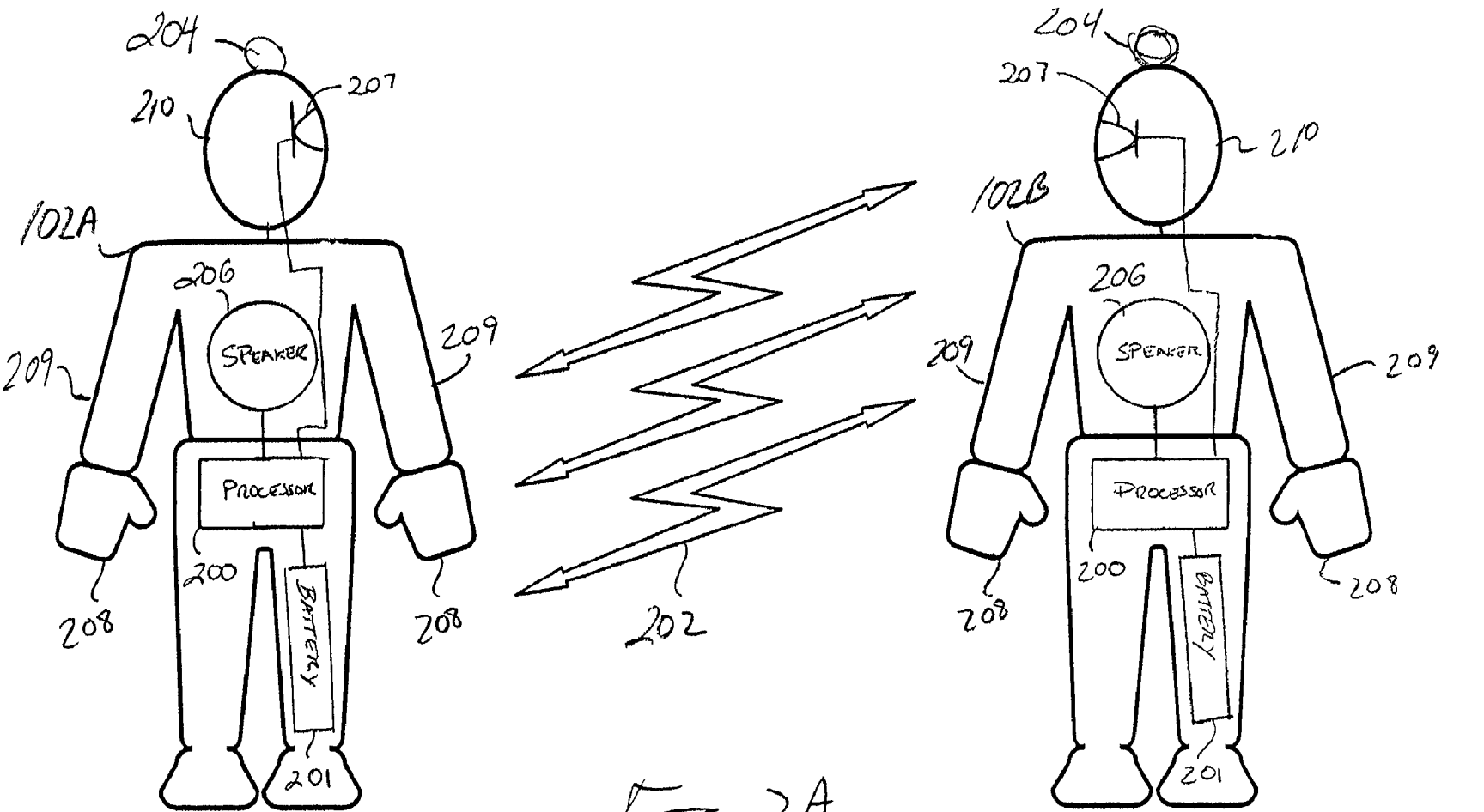
FIG. 2A illustrates a pair of toys or toy characters that can synchronize with each other via wireless communication in accordance with one embodiment of the invention.

Referring now to FIG. 2A, toy characters 102A and 102B are illustrated. The toy characters 102A and 102B can synchronize with each other via wireless communication. The wireless communication 202 may be infrared communication (IR), radio frequency communication (RF), Ultrasound, Magnetic-wave, visible light or any other techniques that allows sensing of the presence or absence of a signal without direct contact between units. Each toy character 102A and 102B includes a start button 204 and a speaker 206. The user can utilize the start button 204 to select which of the toy characters in a neighborhood is to be the master while the other toy characters in the neighborhood remain slaves. The speaker 206 can be used to generate sound effects to simulate interaction between the toy characters 102.

Each toy character 102 may include an antenna to transmit and receive wireless RF signals. For example, the antenna may be located in the arm 209 of the toy character 102. Alternatively, the antenna may be placed elsewhere on the toy character 102. In the case of Ultrasound, each toy character 102 may further include an ultrasonic transducer to generate and receive ultrasonic signals. In the case of infrared each toy may further include an infrared LED and an infrared detector to transmit and receive infrared signals.

Figure 2B:
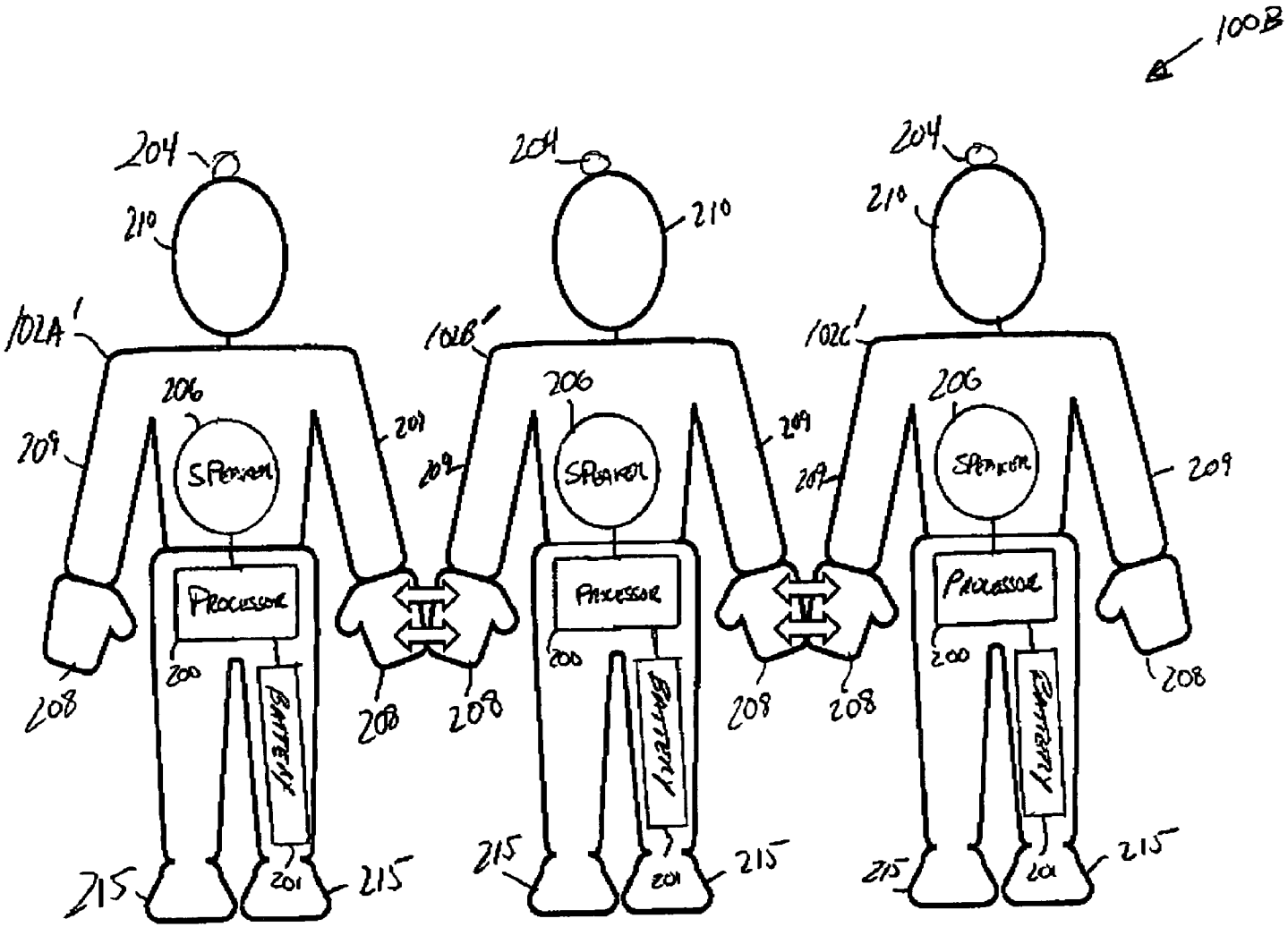
FIG. 2B illustrates a plurality of toys or toy characters touching hands in order to facilitate wired communication in accordance with one embodiment of the invention.

Referring now to FIG. 2B, toy characters 102A', 102B' and 102C' are illustrated. The toy characters 102A', 102B', and 102C' touch each other at the hands 208 in order to facilitate wired communication. For example, hands 208 of characters 102A', 102B', and 102C' are coupled together in order to facilitate communication between them. While the hands 208 can be used as the connection for communication, other contacts and connections may be made between the toy characters 102' to facilitate wired communication among the characters 102' in a neighborhood.

Each toy character 102' includes the start button 204 and the speaker 206. As discussed previously, the start button 204 is for selecting which of the characters 102' shall be the master to which the other remaining characters will be slaves for synchronization purposes. In FIG. 2B, the start button 204 is shown on top of the head 210 of each of the characters 102'. In practice, the start button 204 may be located elsewhere on the character and may also be a switch a touch pad or any other user activated input to the processor.

Figure 2C:
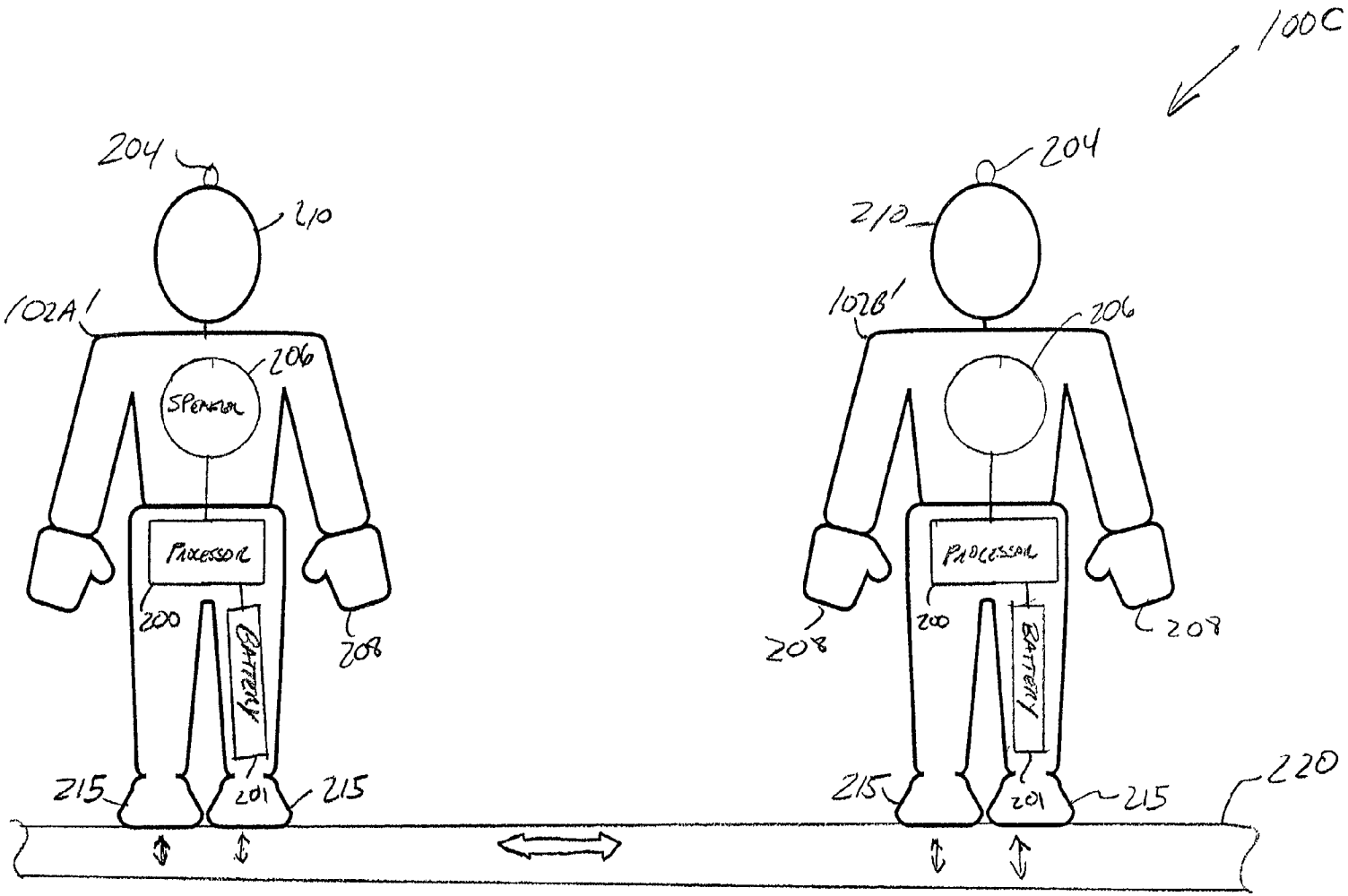
FIG. 2C shows an exemplary play-set or neighborhood having a stage in order to facilitate wired communication in accordance with one embodiment of the invention.

Referring now to FIG. 2C, an exemplary play-set or neighborhood 100C having toy characters 102A',102B' and a stage 220 is shown. In FIG. 2C, wired communication may occur through the neighborhood or play-set 100C. A stage 220 may be provided so that the characters 102' may communicate using wired communication. The feet 215 of each character 102' can couple to the stage 220 for wired communication. Thus The characters 102' may be physically separated yet be able to synchronize through the stage 220 and their respective feet 215.

Referring now to FIGS. 2A-2C, each toy character 102 and 102' includes a processor 200. The processor 200 in each may be operating at a different CPU clock frequency with respect to the others due to CPU oscillator specification tolerances, age and drift in the clock oscillation circuitry, component variations, voltage differences provided by the battery or power 201 to the processor 200 and temperature variations. Each toy character 102 and 102' also includes a battery 201 coupled to the processor 200 to provide power to the processor 200. Each toy character 102 further includes a speaker 206 coupled to the processor 200 50 that the processor can generate audible sounds. The start switch or button 204 may have one pole that couples to ground or power and another pole that couples to the processor 200 in order to signal the processor 200 that the character 102 or 102' has been selected as a master. Wireless communication and wired communication allows one processor 200 to communicate to other processors 200 to synchronize the toy characters 102 or 102' in a neighborhood 100A, 100B, or 100C.

Figure 3:
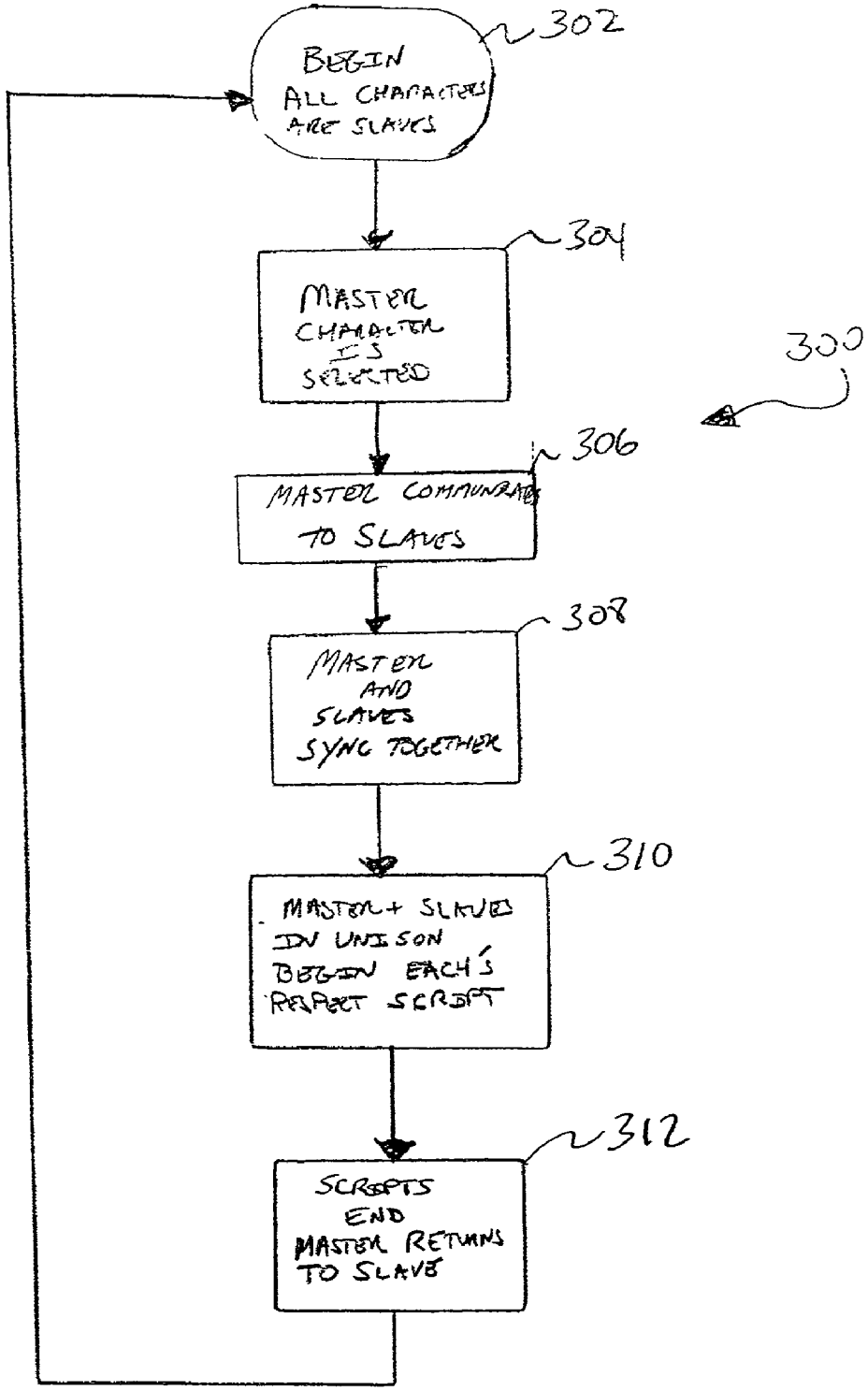
FIG. 3 is an exemplary flowchart outlining the synchronization process and the independent performance of scripts by toy characters in accordance with one embodiment of the invention.

FIG. 3 is an exemplary flowchart outlining a process 300 in which the toys or toy characters in the play-set or neighborhood synchronize their clocks and independently perform their respective roles in accordance with a designated script. In box 302, the units or characters are initially all slaves. Each toy character listens for a synchronization signal emanated from a chosen master or a selection by a user to become a master.

In box 304, a master is chosen by having its start button or switch selected. In box 306, the master communicates to the slaves that it is time to synchronize. In box 308, the master and the slaves synchronize themselves together. The synchronization process may contain one or all of the following functions; wake up signal, script identification, timer synchronization pulse, toy identification and script start signal. In box 310, the master and slaves perform their respective roles in a designated script in unison. The, toy or toy characters can independently perform their respective roles in a designated script, such that continuous communication among the toy characters would not be necessary. In box 312, the toy characters have completed performing their respective roles in the designated script, and return to the begin box 302 where they become slaves once again and are listening for the synchronization signal or selection by a user to become a master so that the process 300 can be repeated.

Figure 4:
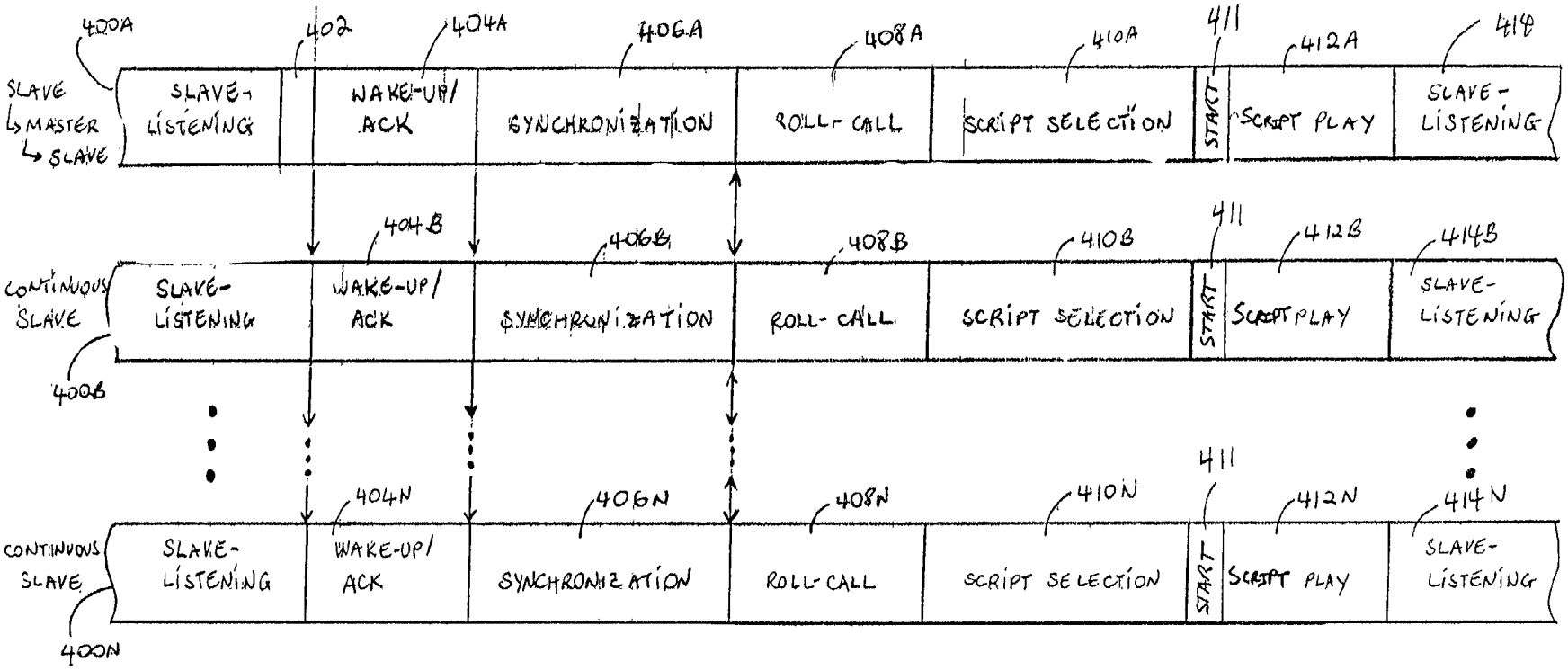
FIG. 4 shows an exemplary cycle diagram for each of N toy characters in accordance with one embodiment of the invention.

Referring now to FIG. 4, an exemplary cycle diagram is illustrated for N toy characters. Cycle diagram 400A illustrates a toy character that is initially a slave then becomes a master momentarily and then after completing the script becomes a slave once again. The cycle diagram 400B illustrates a character that is continuously a slave with respect to the cycles of cycle diagram 400A. The cycle diagram 400N represents the other N slaves that may be in the neighborhood and that remain in a continuous slave mode or cycle with respect to the cycles of cycle diagram 400A illustrated in FIG. 4. Since the scripts of each character may differ in length, the audible signals generated by each may end earlier or later than one another.

All toy characters are initially slaves listening for a synchronization signal as illustrated in cycle diagrams 400A, 400B, and 400N. The user may designate one toy character as the master for example by selecting the start button. The start button is illustrated as designating a master in cycle 402 of the cycle diagram 400A. Once the start button is depressed, the master communicates to the slaves to begin the wake-up and acknowledgement cycle 404A, 404B, . . . , 404N. During the wake-up and acknowledgement cycle 404A, 404B, . . . , 404N, the slaves restart themselves.

Following the wake-up and acknowledgement cycle 404A, 404B, . . . , 404N, the master communicates to the slaves to begin the synchronization cycle 406A, 406B, . . . , 406N. During the synchronization cycle 406A, 406B, . . . , 406N, the slaves synchronize their timers or clocks to the clock of the master. At the end of the synchronization cycle 406A, 406B, . . . , 406N, the toy characters are in sync and can begin the roll-call cycle 408A, 408B, . . . , 408N. During the roll-call cycle, the slaves generally announce their presence to the master.

After the roll-call cycle 408A, 408B, . . . , 408N is complete, the toy characters begin a script selection cycle 410A, 410B, . . . , 410N to choose a script. Following the script selection cycle 410A, 410B, . . . , 410N, the master toy may generate a script start signal 411 in order to initiate the slave toy characters to perform their respective roles in the chosen or designated script during the script play cycle 412A, 412B, . . . , 412N. That is, the script start signal 411 synchronizes the script play and begins the script play cycle 412A, 412B, . . . , 412N. After the script start signal 411 and during the script play cycle 412A, . . . , 412N, there is no more communication needed between the toy characters. At the end of the script play cycle 412A, 412B, . . . , 412N of each respective character, the character returns to a slave mode listening for another synchronization signal from a character that is chosen to be a master. During cycle 414A, cycle 414B, and cycle 414N, the toy characters return to being slaves. As discussed previously, the master is the character which has its start button pushed first.

After being synchronized together in unison, each of the toy characters runs open loop performing their script independent of each other. The script is in essence a toy dialog simulating interaction between toy characters in the play-set or neighborhood. The script generally consists of multiple roles. In one embodiment, the script consists of six roles (one role for the master, and five roles for the slaves). In this embodiment, if more than six roles are present in the play-set or neighborhood, one or more slave characters would be duplicates of either one or more slave characters or of the master character. If multiple units of the same character exist in the play-set or neighborhood, all units of that character will perform the same role.

Figure 5A:
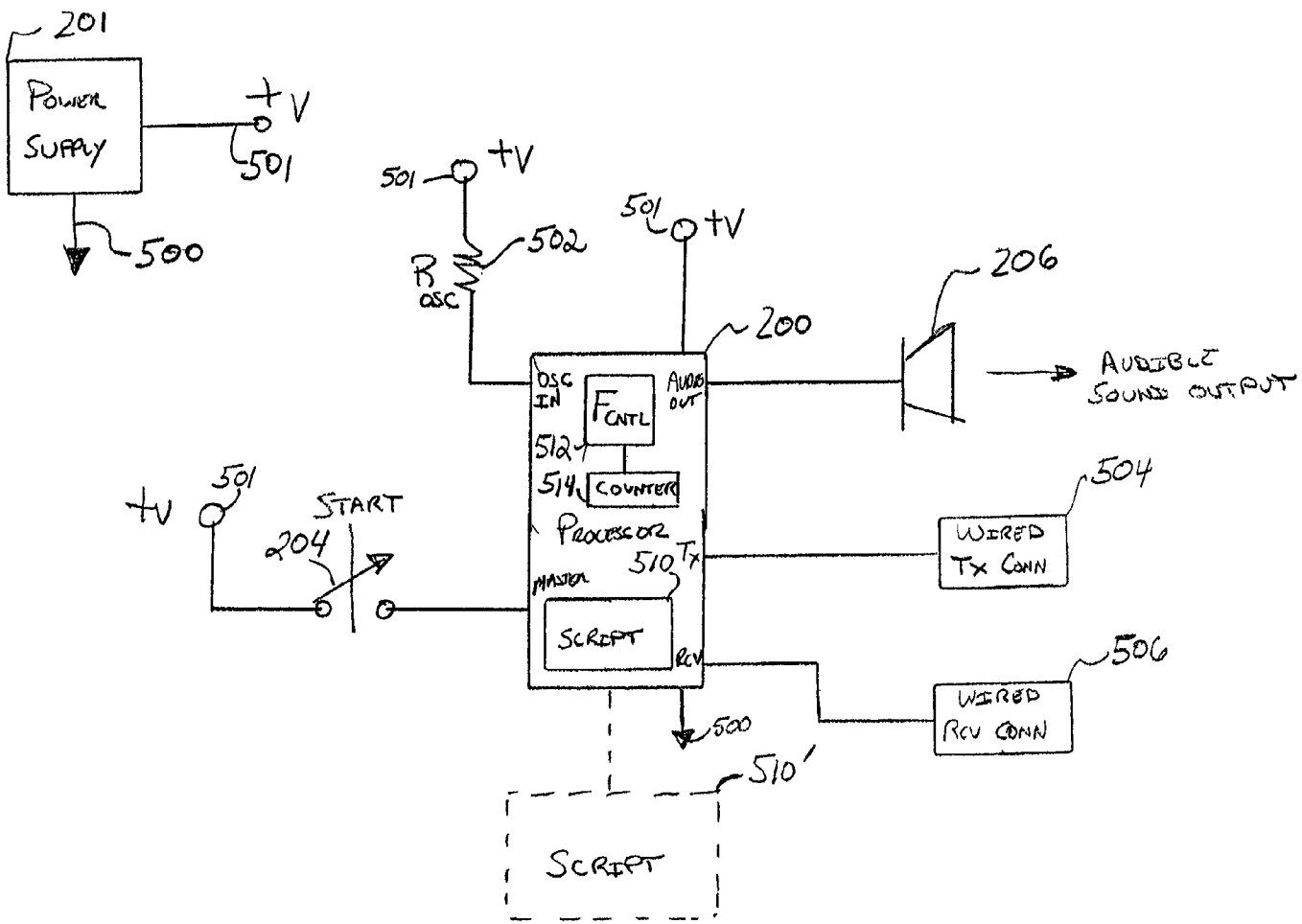
FIG. 5A illustrates an exemplary functional block diagram of the components for an toy character with wired communication.

Referring now to FIG. 5A, an exemplary functional block diagram of the components for a wired character 102' is illustrated. In FIG. 5A, a power supply or battery 201 has one terminal coupled to ground 500 and another terminal coupled to node 501, referred to as positive power supply terminal. The processor 200 couples to the positive power supply terminal 501 and also to ground 500. The processor 200 has an oscillator input coupled to a resistor 502 to generate an oscillating clock. An opposite end of the resistor 502 couples to the positive power supply terminal 501 to couple a current into the oscillator input to cause an oscillator circuit within the processor 200 to oscillate a specific frequency based of the value of the resistor.

The processor 200 may also couple to a wired transmitter connector 504 through a transmit terminal, and to a wired receiver connector 506 through a receive terminal. In addition, the processor 200 couples to a pole of the start switch 204 through a master selection input terminal. The processor 200 further includes a counter or timer 514. The counter or timer 514 may be a hardware counter or timer implemented within the processor or alternatively can be a software counter or timer which is programmed into processor.

The script may be stored into an on chip memory 510 within the processor 200 or alternatively may be stored into an external memory chip 510'. The processor 200 couples to the speaker 206 to convert the electrical signals into audible sounds. The processor 200 uses the stored script to generate electrical signals.

In one embodiment, a pole of the start button 204 couples to the positive power supply 501. In an alternate embodiment, the pole of the start button 204 may couple to ground 500. In any event the start button is coupled to the processor in such a way as to allow the user to send a signal to the processor.

The wired transmitter connector 504 may be a plug or a jack or a contact that can electrically couple to a wired receiver connector 506 of another character. The wired receiver connector 506 may be a plug or a jack or a contact that can electrically couple to a wired transmitter connector 504 of another character. Alternatively connectors 504 and 506 may be a single 2pole plug or jack.

Figure 5B:
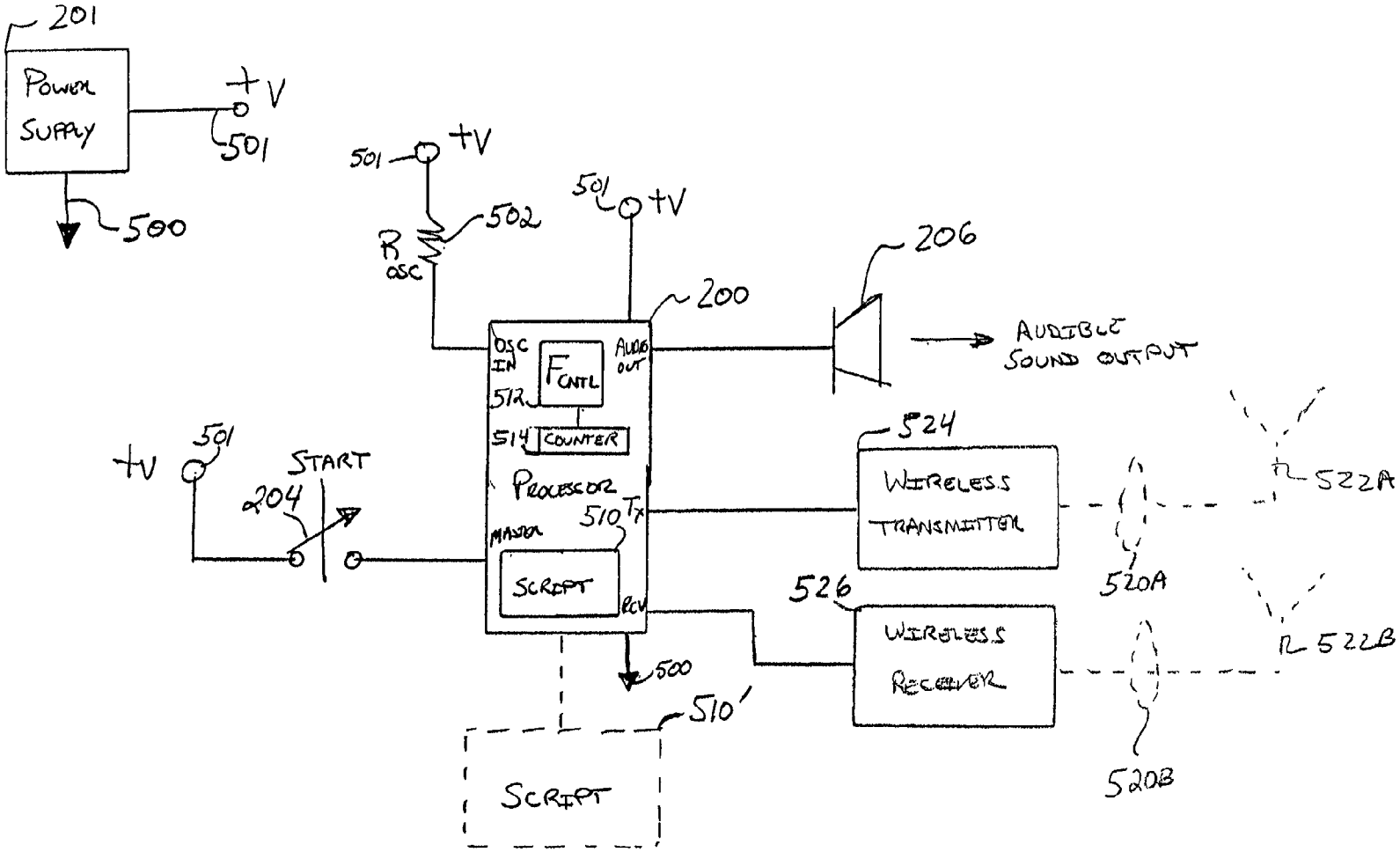
FIG. 5B illustrates an exemplary functional block diagram for of components for toy characters with wireless communication.

Referring now to FIG. 5B, a functional block diagram of components in an toy character to facilitate wireless communication is illustrated. The wired transmitter connector 504 and the wired receiver connector 506 in FIG. 5A are replaced with a wireless transmitter 524 and a wireless receiver 526 respectively in FIG. 5B. Otherwise the functional blocks are similar to those described in FIG. 5A and will not be repeated here again for brevity.

The wireless transmitter 524 may be an infrared wireless transmitter, a radio frequency wireless transmitter, an Ultrasound transmitter, a Magnetic-wave transmitter, or other known types of wireless transmitter. In the case of a radio frequency transmitter, wireless transmitter 524 would couple to an antenna 522A. In case the wireless transmitter 524 is an infrared wireless transmitter, a lens 520A may or may not be placed in front of an infrared light emitting diode in order to collimate outgoing infrared signals.

The wireless receiver 526 may be an infrared wireless receiver, a radio frequency wireless receiver, an Ultrasound receiver, a Magnetic-wave receiver, or other known types of wireless receiver. In the case of a radio frequency receiver, the wireless receiver 526 may couple to the antenna 522B, alternatively antenna 522B may be physically the same antenna as 522A. In the case of an infrared wireless receiver, a lens 520B may or may not be placed in front of an infrared photo-diode to provide focus and optical gain to receive incoming infrared signals.

Figure 6:
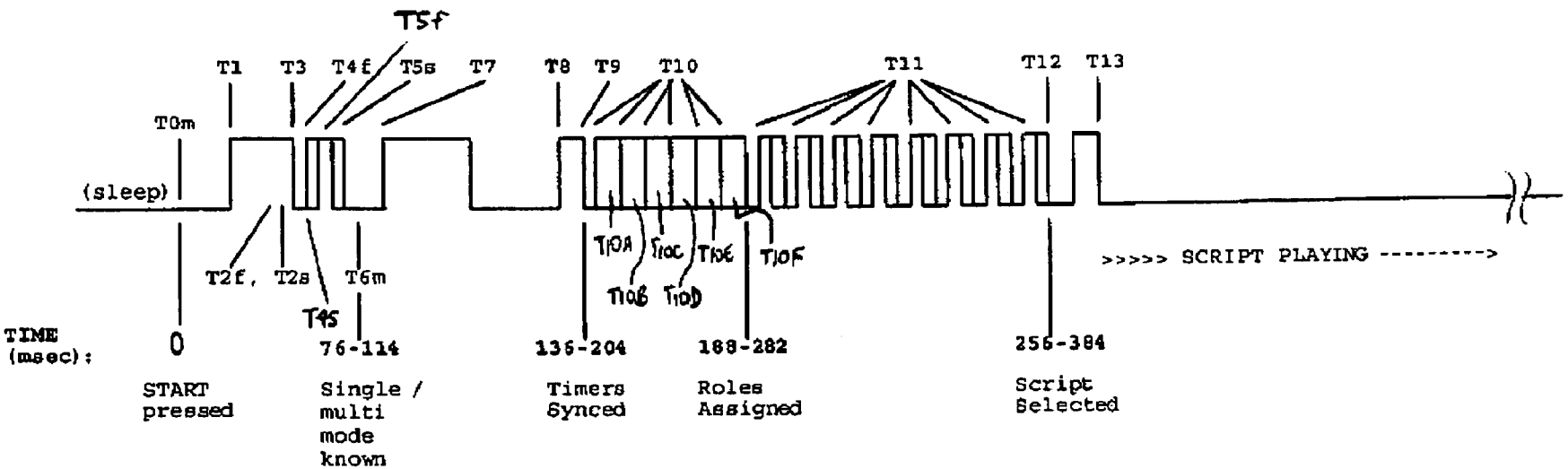
FIG. 6 illustrates an exemplary timing diagram showing exemplary activities or cycles implemented by the toys or toy characters in a play-set or neighborhood.

Referring now to FIG. 6, an exemplary timing diagram of signals showing exemplary activities or cycles implemented by the toys or toy characters 102 or 102' in a play-set or neighborhood is illustrated. It should be noted that the timing diagram of signals of FIG. 6 shows exemplary activities or cycles implemented-for a neighborhood or play-set including six toys or toy characters. It is to be understood that two or more toy characters may be present in a neighborhood and synchronized together. Alternatively, a single toy or toy character may be in a neighborhood and operate in a stand alone or single unit mode.

The baseband signals communicated between toys in a neighborhood, such as those illustrated in FIG. 6, may be modulated onto a center carrier frequency for wireless transmission and demodulated off of the center carrier frequency for wireless reception. In which case, the receivers may be designed to receive a wide range of frequencies around the center carrier frequency in case the difference between the processor clock speeds of the toys is large. Alternatively, the baseband signals communicated between toys in a neighborhood may be directly transmitted and received without modulation in the case of wired communication or some forms of wireless communication, such as infrared.

In the description of the timing diagram below, the following notations will be adopted:

Txm—denotes time point x that is applicable to the master (m) unit.

Txf—denotes time point x that is applicable to the fastest (f) slave unit.

Txs—denotes time point x that is applicable to the slowest (s) slave unit.

In addition, "true times" and "absolute times" will also be used in the description of the timing diagram below. "True times" are generally times measured by the outside world. "Absolute times" are generally true times that are measured from time T0m. It is to be understood that other timing references may be used.

At time T0m, the master toy or toy character is awaken when its start button is pressed or selected and its processor clock begins to oscillate. Time T0m may be referred to as 0 milli-seconds (msec) absolute. In one embodiment, the processor of the master would finish restarting or exiting or coming out of sleep or idle mode at approximately 65,536 processor cycles after the start button of the master is pressed or selected. In this embodiment, the processor of the master would finish restarting or exiting or coming out of a sleep or idle mode at a true time in a range from about 18 msec to about 25 msec if the processor operated at about 3.58 MHz. The sleep or idle mode is a low power mode of operation for an toy character.

At time T1, the master toy or toy character sends a wake-up signal to the slaves to generally tell the slaves to restart or to exit or to come out of the sleep or idle mode. The sending of the wake-up signal begins the wake-up cycle. In one embodiment, T1 is in the range of 20 msec to 30 msec absolute time.

At time T2f and T2s, the fastest and slowest slave toys respectively finish restarting or exiting or coming out of sleep or idle mode. In one embodiment, the fastest slave finishes restarting or exiting or coming out of sleep or idle mode at a true time of approximately T1+20 msec.

At time T3, the master toy releases the wake-up signal to generally signify that the wake-up cycle has ended. As stated above, the wake-up cycle is generally a time duration in which slaves restart themselves. The master should release the wake-up signal at a time that is selected to generally ensure that the slowest slave can wake up and still see about 2 msec of the wake-up signal. In one embodiment, T3 is in the range of T1+32 msec true time to T1+48 msec true time depending on the processor frequency.

At time T4f, the fastest slave toy sends an ACK or acknowledgement signal to the master. In one embodiment, T4f is approximately T3+4 msec true time. The slave generally uses the ACK signal to inform the master that the slave exists. In one embodiment, the ACK signal occurs for a duration of approximately 10 msec. At time T4s, the slowest slave toy sends an ACK or acknowledgement signal to the master. In one embodiment, T4s occurs at approximately T3+8 msec.

At time T5f, the fastest slave toy releases the ACK signal. In one embodiment, TSf is approximately T3+12 msec true time. At time T5s, the slowest slave toy releases the ACK signal. In one embodiment, T5s is approximately T3+20 msec true time.

At time T6n, if the master toy character has not yet received or sensed an ACK signal from a slave, the master assumes that it exists alone in neighborhood or play-set and that it should operate in a single-unit mode which may also be referred to as standalone mode. If the master were to operate in the singleunit mode, it would produce standalone sound at approximately 76 msec to 114 msec absolute time.

However, if the master toy character receives at least one ACK signal, the master selects to operate in a multi-unit mode and begins time synchronization and script control activities. The activities occurring at time T7, T8, T9, T10, T11, T12, and T13 will be described below. It should be noted that these activities are generally related to time synchronization and script control, and would therefore occur only if toy characters in the neighborhood or play-set operate in the multi-unit mode.

At time T7, the first rising edge of a TIMING SYNC or timing synchronization signal occurs. In one embodiment, T7 is in the range of approximately 80 msec to 120 msec absolute time. The master sends the TIMING SYNC or timing synchronization signal to the slaves to generally instruct the slaves to synchronize their clocks or timers with the clock or timer of the master. At time T8, the second rising edge of the TIMING SYNC signal occurs. In one embodiment, T8 is in the range of T7+52 msec true time to T7+78 msec true time. The slaves use the time interval from T7 to T8 to calibrate their clocks or timers to match the clock or timer of the master.

At time T9, the second falling edge of the TIMING SYNC or timing synchronization signal occurs. In one embodiment, time T9 has a range of approximately 136 msec to 204 msec absolute time. At time T9, slaves should have finished synchronizing their clocks or timers with the clock or timer of the master.

At time T10, each slave toy character in the neighborhood or play-set waits for a period of time before sending a roll-call signal to the master. In one embodiment, the slave toys wait for approximately 5 ms before starting roll call, each slave toy then sends out its identifying signal in specific time increments. Slave toys are programmed to respond at specific intervals after T9 so that the master toy can identify specifically which toy or toys have responded. By sending the roll-call signal, the slave generally announces its presence in the neighborhood or play-set. In one embodiment, roll-call signals have a duration of 10 msec.

As stated above, the timing diagram of FIG. 6 shows activities or cycles implemented for a neighborhood or play-set that includes six slave toy characters. Thus, each slave sends a roll-call signal in one of six allotted time slots, T10A, T10B, T10C, T10D, T10E, and T10F. In one embodiment, the time slots have an aggregate time period in the range of about 52 msec to about 78 msec true time ending at approximately 188 to approximately 282 msec absolute time.

At time T11, the master toy waits for a time period before sending script identification (ID) to the slaves to select a script. In one embodiment, the sending of the script ID lasts about 68 msec to about 102 msec true time ending at approximately 256 msec to approximately 384 msec absolute time.

As previously stated, the script is in essence a toy dialog simulating interactive communication (i.e., interaction) between the toy characters in the play-set or neighborhood. The script generally consists of multiple roles. In one embodiment, the script consists of six roles (one role for the master, and five roles for the slaves). In this embodiment, if more than five roles are present in the play-set or neighborhood, one or more slaves would be duplicates of either one or more slaves or of the master. If multiple toys of the same character exist in the play-set or neighborhood, all units of that character will perform the same role.

At time T12, the master toy character sends a begin-script signal to the slaves in the neighborhood or play-set. The begin-script signal generally tells the slaves to start playing the script specified by the script ID that the master previously sent at time T11. In one embodiment, the begin-script signal lasts 20 msec. At time T13, the falling edge of the begin-script signal occurs and starts script playing by the slaves. In one embodiment, time T13 occurs at approximately 272 msec to 408 msec absolute time.

The specific order of information in the synchronization protocol may be re-arranged to suit the specific application. For instance the toys to be synchronized may not be programmed to enter into an off or low power state and therefore the T1 wake up pulse may not be necessary. Similarly, the acknowledge signal of T4 and T5 may not be used and the system can wait for roll call T10 to determine if any other characters are in the neighborhood.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. The invention may be implemented in hardware, software, firmware or a combination thereof and utilized in systems, subsystems, components or sub-components thereof. When implemented in software, the elements of the invention are essentially the code segments to perform the necessary tasks. The program or code segments can be stored in a processor readable medium or transmitted by a computer data signal embodied in a carrier wave over a transmission medium or communication link. The "processor readable medium" may include any medium that can store or transfer information. Examples of the processor readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc. In any case, the invention should not be construed as limited by such embodiments, but rather construed according to the claims that follow below.

What is claimed is:

1. A play-set comprising:

a master toy having a first timer to measure time and a first processor, the master toy to transmit a synchronization signal including a time period reference to begin a synchronization process to synchronize time and scripts; and at least one slave toy having a second timer to measure time and a second processor, the slave toy being momentarily bi-directionally communicatively linked to the master toy to acknowledge itself to the master toy and to synchronize its second timer to the time period reference of the master toy in response to the synchronization signal such that master and slave toy thereafter perform synchronized scripts without further communication.

2. The play-set of claim 1, wherein the slave toy is physically coupled momentarily to the master toy to facilitate wired communication during the synchronization process.

3. The play-set of claim 1, further comprising:

a stage physically coupled to the master toy and the slave toy to facilitate wired communication between the master toy and the slave toy.

4. The play-set of claim 1, wherein the master toy and the slave toy momentarily communicate using wireless communication.

5. The play-set of claim 1, wherein the slave toy to send an acknowledgement signal to the master toy, and the master toy to operate in a multi-unit mode in response to the acknowledgement signal.

6. The play-set of claim 5, wherein the slave toy to send a roll-call signal to the master toy to announce the character identification of the slave toy.

7. The play-set of claim 1, wherein the master toy to send a script identification (ID) to the slave toy to select a script.

8. The play-set of claim 1, wherein the master toy and the slave toy to perform roles in a selected script by generating sounds.

9. The play-set of claim 1, wherein the master toy to transmit a script start signal to the slave toy to simultaneously start a time synchronized scripted sequence.

10. A method comprising:

selecting a first toy having a first timer to designate as a master toy, transmitting a synchronization signal from the master toy including a time period reference to begin a synchronization process to synchronize time and scripts; and receiving the synchronization signal including the time period reference at at least one slave toy having a second timer, the slave toy being momentarily bi-directionally communicatively linked to the master toy to acknowledge itself to the master toy and to synchronize its second timer to the time period reference of the master toy in response to the synchronization signal;

wherein the master toy and slave toy thereafter perform synchronized scripts without further communication.

11. The method of claim 10, further comprising:

coupling the slave toy to the master toy to facilitate wired communication during the synchronization period.

12. The method of claim 10, further comprising:

coupling the master toy and the slave toy to a stage to facilitate wired communication between the master toy and the slave toy.

13. The method of claim 10, further comprising:

using wireless communication to facilitate communication between the master toy and the slave toy.

14. The method of claim 10, further comprising:

sending a wake-up signal from the master toy to the slave toy for the slave toy to restart.

15. The method of claim 10, further comprising:

sending an acknowledgement signal from the slave toy to the master toy for the master toy to operate in a multi-unit mode.

16. The method of claim 15, further comprising:

sending a roll-call signal from the slave toy to the master toy to announce the character identification of the slave toy.

17. The method of claim 10, further comprising:

sending a script identification (ID) from the master toy to the slave toy to select a script.

18. The method of claim 10, further comprising:

sending a start signal from the first toy to the at least one additional toy to synchronize the start of script play.

19. The method of claim 10, further comprising:

generating sounds when the master toy and the slave toy perform time synchronized roles in a selected script.

20. The method of claim 10, wherein the selecting of the first toy to designate as the master is preformed by pressing a button to close a switch.

21. The method of claim 10, wherein the selecting of the first toy to designate as the master is preformed by sliding a slideable knob to close a switch.

22. A toy system comprising:

a plurality of toys communicatively linked to each other, each of the plurality of toys including:

a battery to provide power;

a processor coupled to the battery to receive power, the processor receiving a clock and including a timer, the timer to determine time as a function of the clock;

a selectable switch coupled to the processor, the selectable switch to designate one of the plurality of toys as a master toy and the remainder of the plurality of toys as slave toys;

wherein the master toy includes a first timer to measure time, the master toy to transmit a synchronization signal including a time period reference to begin a synchronization process to synchronize time and scripts; and wherein the slave toy includes a second timer to measure time, the slave toy being momentarily bi-directionally communicatively linked to the master toy to acknowledge itself to the master toy and to synchronize its respective second timer to the time period reference of the master toy in response to the synchronization signal such that master and slave toy thereafter perform synchronized scripts without further communication.

23. The toy system of claim 22, wherein the plurality of toys are momentarily physically coupled together to facilitate wired communication during synchronization.

24. The toy system of claim 22, further comprising:

a stage physically coupled to the plurality of toys to facilitate wired communication between the plurality of toys during synchronization.

25. The toy system of claim 22, wherein the plurality of toys further include:

a wireless transmitter so that the master toy can wirelessly transmit the synchronization signal; and a wireless receiver so that the slave toys can wirelessly receive the synchronization signal.

26. The toy system of claim 22, wherein the master toy to send a start script signal to the slave toys and begin script play; and the slave toys to synchronize the beginning of their script with the start script signal and begin script play in response thereto.

* * * * *